US008029192B2

(12) United States Patent
Weissbrod

(10) Patent No.: US 8,029,192 B2
(45) Date of Patent: Oct. 4, 2011

(54) FLUX BAG

(76) Inventor: Paul A. Weissbrod, S. Euclid, OH (US)

( * ) Notice: Subject to any disclaimer, the term of this patent is extended or adjusted under 35 U.S.C. 154(b) by 524 days.

(21) Appl. No.: 12/275,507

(22) Filed: Nov. 21, 2008

(65) Prior Publication Data

US 2010/0129009 A1 May 27, 2010

(51) Int. Cl.
*B65D 33/06* (2006.01)
*B65D 33/10* (2006.01)
*B65D 30/20* (2006.01)

(52) U.S. Cl. ..... 383/25; 383/10; 383/16; 383/17; 383/120

(58) Field of Classification Search ..... 383/17, 383/18, 20, 25, 16, 10, 120
See application file for complete search history.

(56) References Cited

U.S. PATENT DOCUMENTS 3,454,441 A * 7/1969 Spruyt ..... 156/244.19
3,774,837 A * 11/1973 Franson ..... 383/10
4,812,055 A 3/1989 Prader et al.
5,290,104 A * 3/1994 Sengewald ..... 383/25
D507,494 S 7/2005 Lucas et al.
D507,754 S 7/2005 Lucas et al.
D517,925 S 3/2006 Lucas et al.
D517,926 S 3/2006 Lucas et al.
D519,037 S 4/2006 Lucas et al.
D519,385 S 4/2006 Lucas et al.
D519,847 S 5/2006 Lucas et al.
7,537,387 B2 * 5/2009 Spork et al. ..... 383/88

OTHER PUBLICATIONS

Diamond Crystal Salt, http://www.diamondcrystalsalt.com/Water-Softening/Products/Pellets..., Diamond Crystal, Life-Enhancing Salts, printed from the Internet Mar. 9, 2009, 2 pages.
Toss Machine Components, Inc., 9 Steps to Heatsealing Perfection, 2007, 48 pages.

* cited by examiner

*Primary Examiner* — Jes F Pascua
(74) *Attorney, Agent, or Firm* — Hahn, Loeser & Parks, LLP

(57) ABSTRACT

A bag comprises a sheath which includes a first wall portion and a second wall portion joined longitudinally by gusseted sidewalls portions which define the bag volume. The sheath has gusseted regions having a first sheath thickness and a non-gusseted region between the gusseted regions having a second different sheath thickness. The bag also includes a first handle disposed on the exterior surface of the first wall portion at the first end of the bag and a second handle disposed on the exterior surface of the first wall portion at the second end of the bag. The first handle and second handle have outer regions having a first sheet thickness and an inner region having a second different sheet thickness. The sum of the first sheath thickness and the first sheet thickness is equal to the sum of the second sheath thickness and the second sheet thickness.

20 Claims, 3 Drawing Sheets

FLUX BAG

TECHNICAL FIELD

The invention pertains to bags, and more particularly to handled bags which may be used to hold welding flux.

BACKGROUND OF THE INVENTION

Flux bags may be manufactured using a process known as the form/fill/seal process, wherein a flux bag is formed from a gusseted, tubular sheath known as bag stock. Typically, the bag stock is four layers thick in the gusseted regions but only two layers thick in the remaining non-gusseted regions of the sheath. During the sealing process, the thicker gusseted regions are exposed to higher pressures by the heat seal bands and seal bar(s), while the remaining non-gusseted regions are subjected to relatively lower pressures. This uneven pressure often results in voids in the seal at the transition between the gusseted and non-gusseted regions of the bag, which may result in spilling of the flux from the bag, contamination of the contents of the bag, and/or moisture absorption by the flux contained within the bag.

BRIEF SUMMARY

In one embodiment a bag enclosing a volume having a first end, a second end, a width, and a length comprises a sheath having a first end and a second end. The sheath defines the bag volume and includes a first wall portion and a second wall portion joined longitudinally by gusseted sidewalls portions. The sheath has gusseted regions with a first sheath thickness and a non-gusseted region between the gusseted regions with a second different sheath thickness. The bag also comprises a handle disposed on the exterior surface of the first wall portion at the first end of the bag. The handle has outer regions with a first sheet thickness and an inner region between the outer regions having a second different sheet thickness. The sum of the first sheath thickness and the first sheet thickness is equal to the sum of the second sheath thickness and the second sheet thickness.

In another embodiment, a bag enclosing a volume having a first end, a second end, a width, and a length, the bag comprises a sheath having a first end and a second end, the sheath defining the bag volume and including a first wall portion and a second wall portion joined longitudinally by gusseted sidewalls portions, wherein the sheath has gusseted regions having a first sheath thickness and a non-gusseted region between the gusseted regions having a second different sheath thickness. The bag further comprises a first handle disposed on the exterior surface of the first wall portion at the first end of the bag and a second handle disposed on the exterior surface of the first wall portion at the second end of the bag. Both the first handle and second handle have outer regions with a first sheet thickness and an inner region between the outer regions having a second different sheet thickness. The sum of the first sheath thickness and the first sheet thickness is equal to the sum of the second sheath thickness and the second sheet thickness.

In another embodiment, a bag enclosing a volume having a first end, a second end, a width, and a length, the bag comprises a sheath having a first end and a second end, the sheath defining the bag volume and including a first wall portion and a second wall portion joined longitudinally by gusseted sidewalls portions, wherein the sheath has gusseted regions having a first sheath thickness and a non-gusseted region between the gusseted regions having a second different sheath thickness. The bag also comprises a first handle having a width substantially equal to the width of the non-gusseted region, with the first handle being fixedly attached to the exterior surface of the first wall portion at the first end of the bag by a means for attachment. The bag further comprises a second handle having a width substantially equal to the width of the non-gusseted region, with the second handle fixedly attached to the exterior surface of the first wall portion at the second end of the bag by a means for attachment. Both the first handle and second handle have a same sheet thickness, and the sum of the first sheath thickness is equal to the sum of the second sheath thickness and the sheet thickness. The bag includes a first transverse heat seal at the first end of the bag through the first sheath thickness in the gusseted regions and through the sheet thickness of the first handle and the second sheath thickness in the non-gusseted region. The bag also includes a second transverse heat seal at the second end of the bag through the first sheath thickness in the gusseted regions and through the sheet thickness of the second handle and the second sheath thickness in the non-gusseted region.

DETAILED DESCRIPTION OF THE INVENTION

Figure 1:
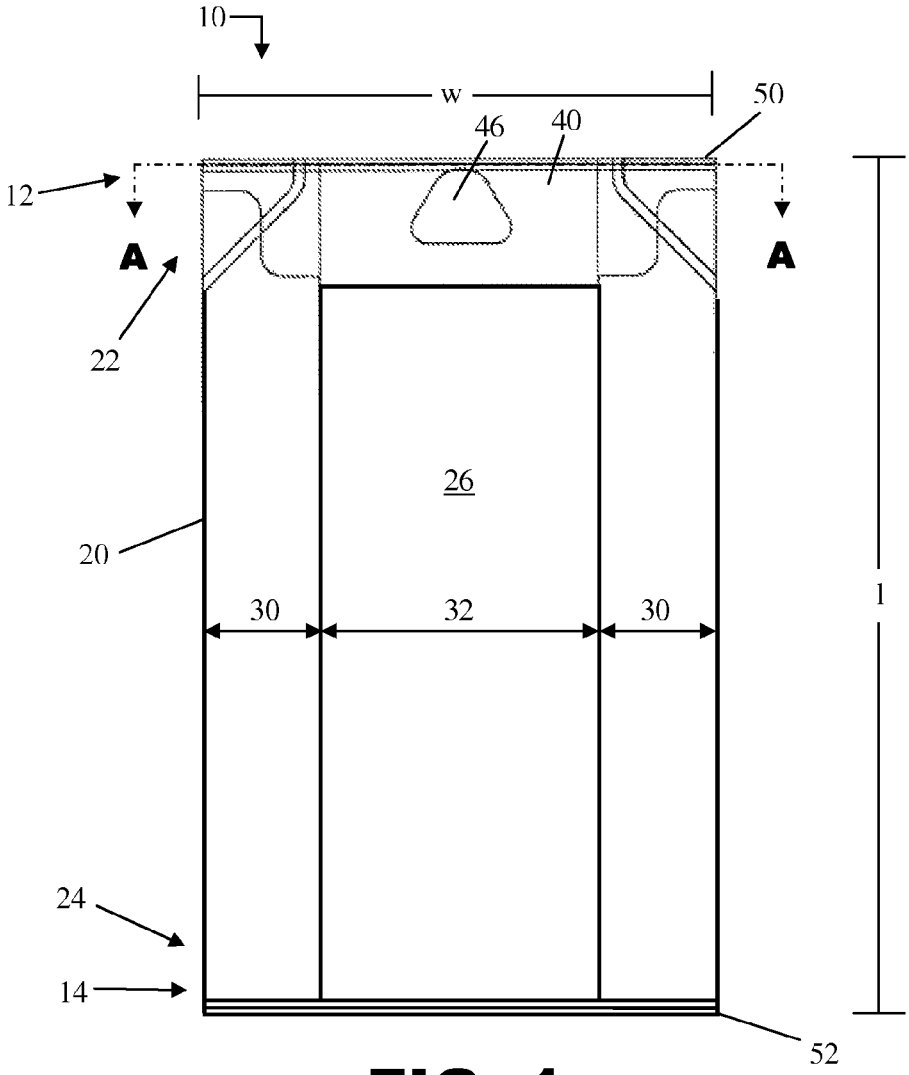
FIG. 1 is a front elevation view showing an embodiment of the subject.
Figure 2:
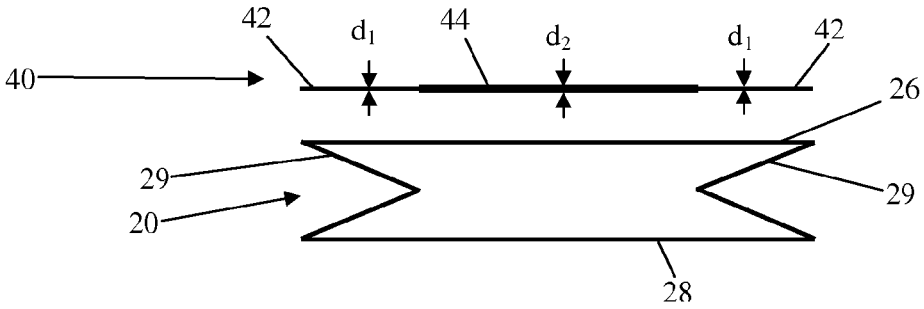
FIG. 2 is an exploded cross-sectional view of the bag of FIG. 1.

Referring now to the drawings wherein the showings are for purposes of illustrating embodiments of the subject invention only and not for purposes of limiting the same, FIGS. 1 and 2 show a bag 10 which may have a first end 12 and a second end 14. In one embodiment, the bag 10 may comprise a sheath 20 and a handle 40.

In construction, the sheath 20 and the handle 40 may be formed of a heat-sealable material. A heat-sealable material is defined to mean a material which may be bonded to itself or another material by heat and pressure to form a seal or closure, for example a seal or closure against air, moisture, or tampering. By way of example, the heat-sealable material may be a thermoplastic material, but it is envisioned that the sheath 20 and the handle 40 may be constructed of any heat-sealable material known in the art. More specifically, the heat-sealable material may be low density polyethylene. However, it is further envisioned that the sheath 20 and handle 40 may each be constructed of different heat-sealable materials, that is the sheath 20 may be constructed of one heat-sealable material and the handle 40 may be constructed of a different heat-sealable material. It is also contemplated that the sheath 20 may comprise a laminate of at least a heat-sealable material and a second material. For example, in an application requiring a moisture impermeable bag, the sheath 20 may comprise an exterior plastic layer which may be optionally heat-sealable, an intermediate metal foil layer which may be moisture impermeable, and an interior heat-sealable material.

Referring again to FIGS. 1 and 2, the sheath 20 may also have a sheath first end 22 corresponding to the bag first end 12 and a sheath second end 24 corresponding to the bag second end 14. The sheath 20 may include a first wall portion 26 and a second wall portion 28, and the first and second wall portions 26, 28 may be joined longitudinally by gusseted sidewall portions 29. The sheath 20 may define the volume of the bag 10.

When the arrangement of the sheath 20 shown in FIG. 2 is completely collapsed, the first wall portion 26, the second wall portion 28, and the gusseted sidewall portions 29 are essentially parallel. Thus, the sheath 20 may have two gusseted regions 30 which extend inward from the longitudinal edges of the sheath 20 a width which is substantially the distance which the sidewall portions 29 extend inward from the edges of the first and second wall portions 26, 28.

In the gusseted regions 30, the sheath 20 may have a first sheath thickness which is substantially equal to the sum of the thicknesses of the first wall portion 26, the second wall portion 28, and the gusseted sidewall portions 29. The sheath 20 may also have a non-gusseted region 32, which may be located between the gusseted regions 30 and may have a second sheath thickness which is substantially equal to the sum of the thicknesses of the first wall portion 26 and the second wall portion 28.

The handle 40 may be disposed on the exterior surface of the first wall portion 26 at the first end of the bag 12. The handle 40 may include outer regions 42 which may have a first sheet thickness $d_1$ and an inner region 44 which may have a second different sheet thickness $d_2$. In one embodiment, the width of the outer regions 42 may be substantially equal to the width of the gusseted regions 30, the width of the inner region 44 may be substantially equal to the width of the non-gusseted region 32, and the handle 40 may extend across the width w of the bag 40. The handle 40 may also extend longitudinally from a position adjacent the first end of the bag 12 toward the second end of the bag 14. It is also envisioned that the handle 40 may include a handle aperture 46.

Referring still to FIG. 1, the bag 10 may include a first transverse heat seal 50 formed through the thicknesses of the sheath 20 and through the thicknesses of the handle 40. The heat seal may be formed by a heat sealing process known in the art, wherein the sheath 20 and the handle 40 are subjected to temperature and pressure sufficient to form a heat seal. Such heat sealing process is described in Toss Machine Components, Inc.'s "9 Steps to Heat Sealing Perfection," herein incorporated by reference. In one example, the temperature may be about 140° C. and the pressure may be about 50 pounds per square inch of seal band surface when forming a heat seal in low density polyethylene.

In one embodiment, as shown in FIG. 2, the first sheath thickness (four layers) in the gusseted area 30 plus the first sheet thickness $d_1$ (one layer) in the outer regions 42 may be equal to five layers of material. Furthermore, the second sheath thickness (two layers) in the non-gusseted area 32 plus the second sheet thickness $d_2$ in the inner region 44 (three layers) may also be equal to five layers of material. As such, the cross-sectional thickness of the bag 10 may be uniform across the width w of the bag 10 when the first heat seal 50 is formed, thereby overcoming the difficulties of non-uniform thickness experienced by prior art bags during the heat sealing process. In one embodiment, the ratio of the first sheath thickness to the second sheath thickness may be about 4:2. It is also envisioned that the ratio of the second sheet thickness $d_2$ to the first sheet thickness $d_1$ may be about 3:1. In another embodiment, the first sheath thickness may be about 0.03464 inches thick, the second sheath thickness may be about 0.01732 inches thick, the first sheet thickness $d_1$ may be about 0.00866 inches thick, and the second sheet thickness $d_2$ may be about 0.02598 inches thick.

Similarly, a second transverse heat seal 52 may be formed through the thicknesses of the sheath 20 at the second end of the bag 52. In one aspect, it is envisioned that the second heat seal 52 may extend across the width w of the bag 10.

Figure 3:
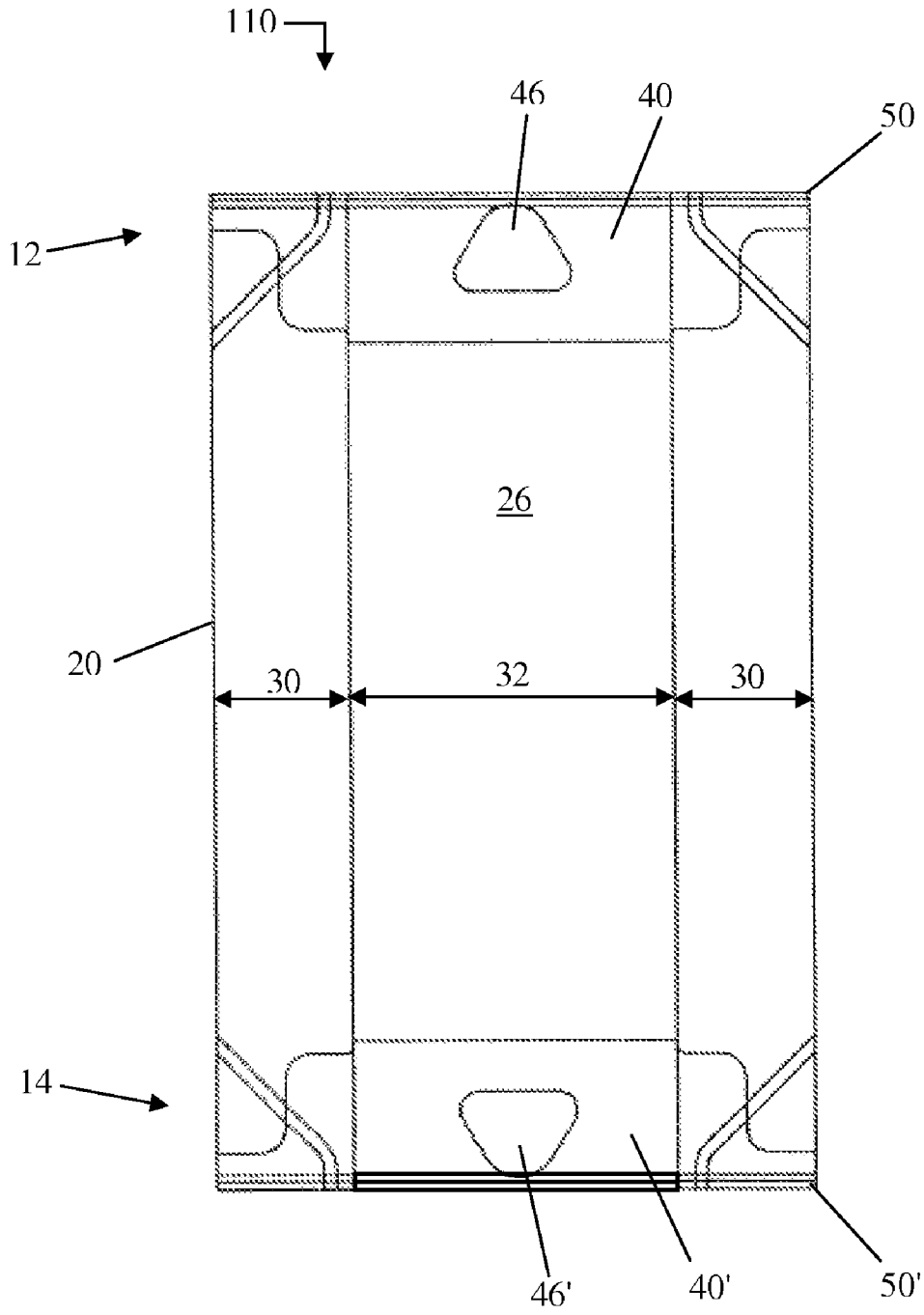
FIG. 3 is a front elevation view of another embodiment of the subject invention.

In another embodiment of a bag 110 shown in FIG. 3, a first handle 40 may be disposed on the exterior surface of the first wall portion 26 located at a first end of the bag 12 and a second handle 40' may be disposed on the exterior of the first wall portion 26 at a second end of the bag 14. Further, a first transverse heat seal 50 may be formed through the thicknesses of the sheath 20 and the first handle 40 at the first end of the bag 12, and a second transverse heat seal 50' may be formed through the thicknesses of the sheath 20 and the second handle 40' at the second end of the bag 14. In one aspect, it is envisioned that the first handle 40 may include a handle aperture 46 and the second handle 40' may also include a handle aperture 46'.

Figure 4:
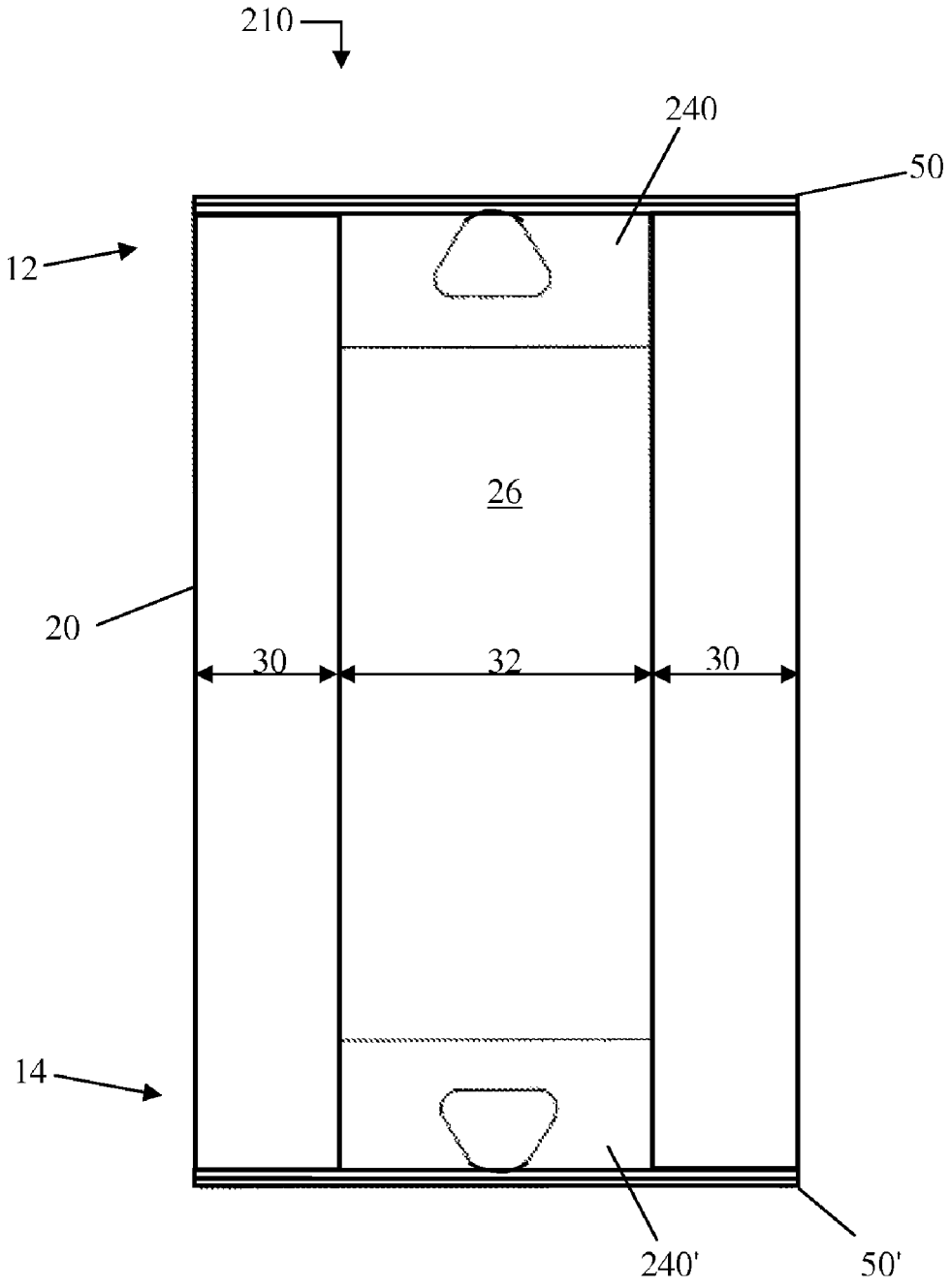
FIG. 4 is a front elevation view of still another embodiment of the subject invention.

A still further embodiment of a bag 210 is shown in FIG. 4. The bag 210 may comprise a sheath 20 having gusseted regions 30 with a first sheath thickness and a non-gusseted region 32 having a second sheath thickness. The bag 210 may also comprise a first handle 240 located at a first end of the bag 12 and a second handle 240' located at a second end of the bag 14. The handles 240, 240' may have a width substantially equal to the width of the non-gusseted region 32 and may have a same sheet thickness. The first sheath thickness may be equal to the sum of the second sheath thickness and the sheet thickness.

The handles 240, 240' may be fixedly attached to exterior surface of the first wall portion 26 at the first and second ends of the bag, respectively, by a means for attachment. Such means for attachment may include, for example, a heat seal or an adhesive.

The bag 210 may also include a first transverse heat seal 50 at the first end of the bag 12 through the first sheath thickness in the gusseted regions 30 and through the sheet thickness of the first handle 50 and the second sheath thickness in the non-gusseted region 32. Additionally, the bag 210 may a second transverse heat seal 50' at the second end of the bag 14 through the first sheath thickness in the gusseted regions 30 and through the sheet thickness of the second handle 240' and the second sheath thickness in the non-gusseted region 32.

The invention has been described herein with reference to the disclosed embodiments. Obviously, modifications and alterations will occur to others upon a reading and understanding of this specification. It is intended to include all such modifications and alterations insofar as they come within the scope of the appended claims or the equivalence thereof.

What is claimed is:

1. A bag enclosing a volume having a first end, a second end, a width, and a length, the bag comprising:

a sheath having a first end and a second end, the sheath defining the bag volume and including a first wall portion and a second wall portion joined longitudinally by gusseted sidewalls portions, wherein the sheath has gusseted regions having a first sheath thickness and a non-gusseted region between the gusseted regions having a second different sheath thickness; and a handle disposed on the exterior surface of the first wall portion at the first end of the bag, wherein the handle has outer regions having a first sheet thickness and an inner region between the outer regions having a second different sheet thickness;

wherein the sum of the first sheath thickness and the first sheet thickness is equal to the sum of the second sheath thickness and the second sheet thickness.

2. The bag of claim 1, wherein the handle extends longitudinally from a position adjacent the first end of the bag toward the second end of the bag and extends transversely across the width of the bag.

3. The bag of claim 1, wherein the handle includes a handle aperture.

4. The bag of claim 1, wherein the bag includes a first transverse heat seal through the thicknesses of the sheath and the first handle at the first end of the bag.

5. The bag of claim 1, wherein the bag includes a second transverse heat seal through the thicknesses of the sheath at the second end of the bag.

6. The bag of claim 1, wherein the ratio of the first sheath thickness to the second sheath thickness is about 4:2.

7. The bag of claim 1, wherein the ratio of the second sheet thickness to the first sheet thickness is about 3:1.

8. The bag of claim 1, wherein the first sheath thickness is about 0.03464 inches, the second sheath thickness is about 0.01732 inches, the first sheet thickness is about 0.00866 inches, and the second sheet thickness is about 0.02598 inches.

9. The bag of claim 1, wherein both the sheath and the handle comprise at least a heat-sealable material.

10. A bag enclosing a volume having a first end, a second end, a width, and a length, the bag comprising:

a sheath having a first end and a second end, the sheath defining the bag volume and including a first wall portion and a second wall portion joined longitudinally by gusseted sidewalls portions, wherein the sheath has gusseted regions having a first sheath thickness and a non-gusseted region between the gusseted regions having a second different sheath thickness; and a first handle disposed on the exterior surface of the first wall portion at the first end of the bag; and a second handle disposed on the exterior surface of the first wall portion at the second end of the bag;

wherein both the first handle and second handle have outer regions having a first sheet thickness and an inner region between the outer regions having a second different sheet thickness, further wherein the sum of the first sheath thickness and the first sheet thickness is equal to the sum of the second sheath thickness and the second sheet thickness.

11. The bag of claim 10, wherein the first handle extends longitudinally from a position adjacent the first end of the bag toward the second end of the bag and extends transversely across the width of the bag, further wherein the second handle extends longitudinally from a position adjacent the second end of the bag toward the first end of the bag and extends transversely across the width of the bag.

12. The bag of claim 10, wherein both the first handle and the second handle include a handle aperture.

13. The bag of claim 10, wherein the bag includes a first transverse heat seal through the thicknesses of the sheath and the first handle at the first end of the bag, further wherein the bag includes a second transverse heat seal through the thicknesses of the sheath and the second handle at the second end of the bag.

14. The bag of claim 10, wherein the first sheath thickness is about 0.03464 inches, the second sheath thickness is about 0.01732 inches, the first sheet thickness is about 0.00866 inches, and the second sheet thickness is about 0.02598 inches.

15. The bag of claim 10, wherein the ratio of the first sheath thickness to the second sheath thickness is about 4:2.

16. The bag of claim 10, wherein the ratio of the second sheet thickness to the first sheet thickness is about 3:1.

17. The bag of claim 10, wherein both the sheath and the handles comprise at least a heat-sealable material.

18. The bag of claim 10, wherein the heat-sealable material is low density polyethylene.

19. The bag of claim 17, wherein the sheath further comprises a metal foil.

20. A bag enclosing a volume having a first end, a second end, a width, and a length, the bag comprising:

a sheath having a first end and a second end, the sheath defining the bag volume and including a first wall portion and a second wall portion joined longitudinally by gusseted sidewalls portions, wherein the sheath has gusseted regions having a first sheath thickness and a non-gusseted region between the gusseted regions having a second different sheath thickness;

a first handle having a width substantially equal to the width of the non-gusseted region, the first handle fixedly attached to the exterior surface of the first wall portion at the first end of the bag by a means for attachment; and a second handle having a width substantially equal to the width of the non-gusseted region, the second handle fixedly attached to the exterior surface of the first wall portion at the second end of the bag by a means for attachment; and wherein both the first handle and second handle have a same sheet thickness, wherein the first sheath thickness is equal to the sum of the second sheath thickness and the sheet thickness;

wherein the bag includes a first transverse heat seal through the first sheath thickness in the gusseted regions and through the sheet thickness of the first handle and the second sheath thickness in the non-gusseted region at the first end of the bag; and further wherein the bag includes a second transverse heat seal through the first sheath thickness in the gusseted regions and through the sheet thickness of the second handle and the second sheath thickness in the non-gusseted region at the second end of the bag.

* * * * *